US009756889B2

(12) United States Patent
Infusino et al.

(10) Patent No.: US 9,756,889 B2
(45) Date of Patent: Sep. 12, 2017

(54) PROTECTIVE SPORTS HELMET CHINSTRAP ASSEMBLY

(71) Applicant: Riddell, Inc., Rosemont, IL (US)

(72) Inventors: Ralph Infusino, Bloomingdale, IL (US); Nelson Kraemer, Mount Prospect, IL (US); Vittorio Bologna, Elk Grove, IL (US)

(73) Assignee: Riddell, Inc., Rosemont, IL (US)

( * ) Notice: Subject to any disclaimer, the term of this patent is extended or adjusted under 35 U.S.C. 154(b) by 0 days.

(21) Appl. No.: 14/021,899

(22) Filed: Sep. 9, 2013

(65) Prior Publication Data

US 2014/0068844 A1 Mar. 13, 2014

Related U.S. Application Data

(60) Provisional application No. 61/698,987, filed on Sep. 10, 2012.

(51) Int. Cl.
*A42B 3/08* (2006.01)

(52) U.S. Cl.
CPC ..... *A42B 3/08* (2013.01)

(58) Field of Classification Search
CPC ..... A41D 13/00; A41D 13/0002; A41D 13/0007; A41D 13/0512; A41D 13/015; A41D 13/0525; A41D 13/0543; A41D 13/0012; A41D 13/05; A41D 2400/24; A41D 13/001; A41D 13/02; A41D 13/065; A41D 13/1245; A42B 3/08; A42B 3/0473; A42B 3/145; A42B 3/085; A42B 3/20; A42B 3/0406; A42B 3/125; A42B 3/326; A42B 3/00; A42B 3/16; A42B 3/04; A42B 3/12; A42B 3/122; A42B 3/205; A42B 3/06; A42B 3/18; A42B 3/221; A42B 3/328
USPC ..... 2/421, 9, 425, 424, 410, 411, 412, 455
See application file for complete search history.

(56) References Cited

U.S. PATENT DOCUMENTS

| | | | | |
|---|---|---|---|---|
| 1,262,818 A | | 4/1918 | McGill | |
| 2,140,716 A | | 5/1935 | Pryale | |
| 2,250,275 A | | 7/1941 | Riddell | |
| 2,867,811 A | | 1/1959 | Jones | |
| 3,166,761 A | | 1/1965 | Strohm | |
| 3,186,004 A | | 6/1965 | Carlini | |
| 3,187,342 A | * | 6/1965 | Aileo | A42B 3/08 2/421 |
| 3,274,613 A | | 9/1966 | Sowle | |
| 3,327,316 A | | 6/1967 | Pukish, Jr. | |

(Continued)

FOREIGN PATENT DOCUMENTS

GB 1354719 5/1974

OTHER PUBLICATIONS

Riddell® 2008, Multi-Sport catalog, including cover page and football chin straps (p. 14).

*Primary Examiner* — Anna Kinsaul
*Assistant Examiner* — Catherine M Ferreira
(74) *Attorney, Agent, or Firm* — McDermott Will & Emery LLP

(57) ABSTRACT

A chin strap assembly is provided for use with a sports helmet. The chin strap assembly includes an inner pad member, a strap assembly and an outer protective member. The outer protective member is connected and released from the strap assembly by an attachment member, such as a post. A sports helmet with the chin strap assembly is also provided.

24 Claims, 10 Drawing Sheets

(56) References Cited

U.S. PATENT DOCUMENTS

| | | | | | |
|---|---|---|---|---|---|
| 3,619,813 | A | | 11/1971 | Marchello | |
| 3,761,959 | A | | 10/1973 | Dunning | |
| 3,787,895 | A | | 1/1974 | Belvedere | |
| 3,916,446 | A | | 11/1975 | Gooding | |
| 4,044,400 | A | | 8/1977 | Lewicki et al. | |
| 4,075,714 | A | | 2/1978 | Ryder et al. | |
| 4,398,306 | A | | 8/1983 | Gooding | |
| 4,461,044 | A | | 7/1984 | Reiterman et al. | |
| 4,646,368 | A | | 3/1987 | Infusino et al. | |
| 4,651,356 | A | | 3/1987 | Zide | |
| 4,692,947 | A | | 9/1987 | Black et al. | |
| 4,741,054 | A | * | 5/1988 | Mattes | 2/421 |
| 4,853,980 | A | | 8/1989 | Zarotti | |
| 5,177,816 | A | | 1/1993 | Schmidt et al. | |
| 5,347,660 | A | * | 9/1994 | Zide | A42B 3/08 2/421 |
| 5,732,414 | A | | 3/1998 | Monica | |
| 5,794,274 | A | * | 8/1998 | Kraemer | A42B 3/205 2/421 |
| 6,081,932 | A | * | 7/2000 | Kraemer | 2/421 |
| 6,189,156 | B1 | | 2/2001 | Loiars | |
| 6,298,483 | B1 | * | 10/2001 | Schiebl et al. | 2/9 |
| 6,481,024 | B1 | * | 11/2002 | Grant | A42B 3/08 2/421 |
| 6,934,971 | B2 | | 8/2005 | Ide et al. | |
| D526,746 | S | * | 8/2006 | Wong | D29/122 |
| 7,886,370 | B2 | * | 2/2011 | Winningham | 2/421 |
| 7,900,279 | B2 | | 3/2011 | Kraemer et al. | |
| 7,921,475 | B2 | * | 4/2011 | Nascimento et al. | 2/410 |
| 8,056,151 | B2 | | 11/2011 | Bologna et al. | |
| 8,621,671 | B1 | * | 1/2014 | Schiebl | 2/421 |
| D715,005 | S | * | 10/2014 | Schiebl | D29/122 |
| 2002/0104533 | A1 | | 8/2002 | Kalhok et al. | |

* cited by examiner

PROTECTIVE SPORTS HELMET CHINSTRAP ASSEMBLY

CROSS-REFERENCE TO RELATED APPLICATIONS

The present application claims the benefit of priority under 35 U.S.C. §119 from U.S. Provisional Patent Application Ser. No. 61/698,987 entitled "HELMET CHINSTRAP ASSEMBLY," filed on Sep. 10, 2012, the disclosure of which is hereby incorporated by reference in its entirety for all purposes.

TECHNICAL FIELD

The invention relates to a chinstrap assembly for securing a helmet to the head of a player engaged in a contact sport, such as football, lacrosse or hockey. The chinstrap assembly includes a flexible inner pad member and a substantially rigid outer protective member that is removably attached to the inner pad member.

BACKGROUND OF THE INVENTION

Chinstraps are known for securing helmets to the heads of players in contact sports such as football, lacrosse or hockey. Chinstraps generally include a cup portion that overlies the wearer's chin, and straps that extend from the cup and attach to the helmet. There are generally two types of cups—a soft cup comprising an assembly of flexible fabrics such as vinyl, nylon, and the like, and a hard cup that includes a rigid outer portion and a padded inner portion rigidly attached, typically by gluing, to the rigid outer portion. An example of a hard cup chinstrap is shown in U.S. Pat. No. 6,081,932, entitled, "CHIN STRAP ASSEMBLY FOR USE WITH AN ATHLETIC HELMET."

Soft cups are often integrally formed with the straps, for example, the straps are arranged to criss-cross over the wearer's jaw bone on each side of the wearer's chin, and a web of fabric is stitched into the resulting oblong space between the straps to overlie the wearer's chin. Hard cups often include slots formed in the rigid outer portion, which is typically formed of an impact resistant plastic, and the straps extend through or otherwise coupled to the slots. As mentioned above, an inner pad member is typically glued and permanently attached to the rigid outer portion.

While soft cups can flex to accommodate the player's anatomical features to provide a more customized fit, they provide less protection for the wearer's chin compared to hard cups. A hard cup, while providing increased protection of the wearer's chin, may not fit as well as a soft cup because of the rigidity of the hard cup.

In addition to being less comfortable, a poorly fitting chinstrap assembly may also be less effective at maintaining the helmet in an appropriate location on the wearer's head, which can reduce the overall level of protection for the user. Features and advantages of the invention will be apparent to those skilled in the art upon review of the following detailed description and accompanying drawings.

DETAILED DESCRIPTION

Figure 1:
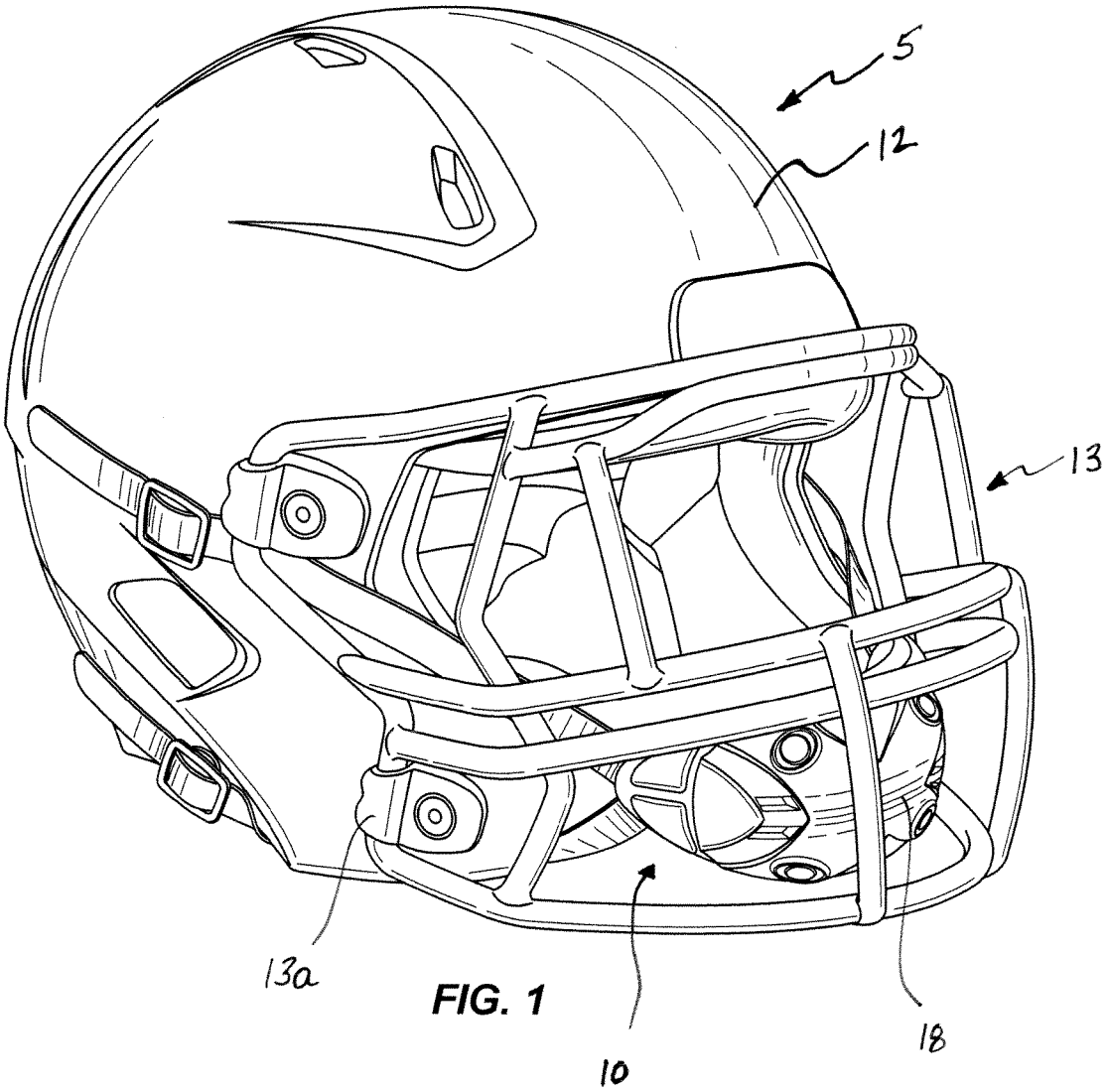
FIG. 1 is a perspective view of a protective sports helmet with a chinstrap assembly.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIGS. 1-8 illustrate a protective sports helmet 5 and a chinstrap assembly 10 according to the invention. The sports helmet 5 includes a protective outer shell 12 and a face guard or face mask 13, which is configured to protect the facial area of the wearer of the helmet 5. The face mask 13 is coupled to the shell 12 by a plurality of connectors 13*a*. When the helmet 5 is properly positioned on the wearer's head, the chinstrap assembly 10 engages a substantial portion of the wearer's chin and is positioned generally at or below a lower portion of the face mask 13. The sports helmet 5 is shown to be a football helmet, however, the chin strap assembly 10 can be utilized with a hockey or lacrosse helmet.

The chinstrap assembly 10 includes a flexible first or inner pad member 14, a substantially rigid second or outer protective member 18, and a strap assembly 22. The strap assembly 22 extends through the inner pad member 14, and the outer protective member 18 is coupled to the strap assembly 22, as explained below. The configuration of the inner pad member 14, the outer protective member 18, and strap assembly 22 permits relative movement between the inner pad member 14 and the outer protective member 18, which can result in an improved fit for the wearer. In some embodiments, including the illustrated embodiment, the outer protective member 18 is releasably coupled to the strap assembly 22 and can therefore be removed from the strap assembly 22, generally without the use of tools. Such releasable coupling can allow a user to quickly and easily change the outer protective member 18, for example if the outer protective member 18 becomes damaged, or to change the appearance of the overall chinstrap assembly 10 by exchanging an outer protective member 18 of one color for an outer protective member 18 of a different color. In other embodiments the outer protective member 18 may be permanently coupled to the strap assembly 22.

Figure 3:
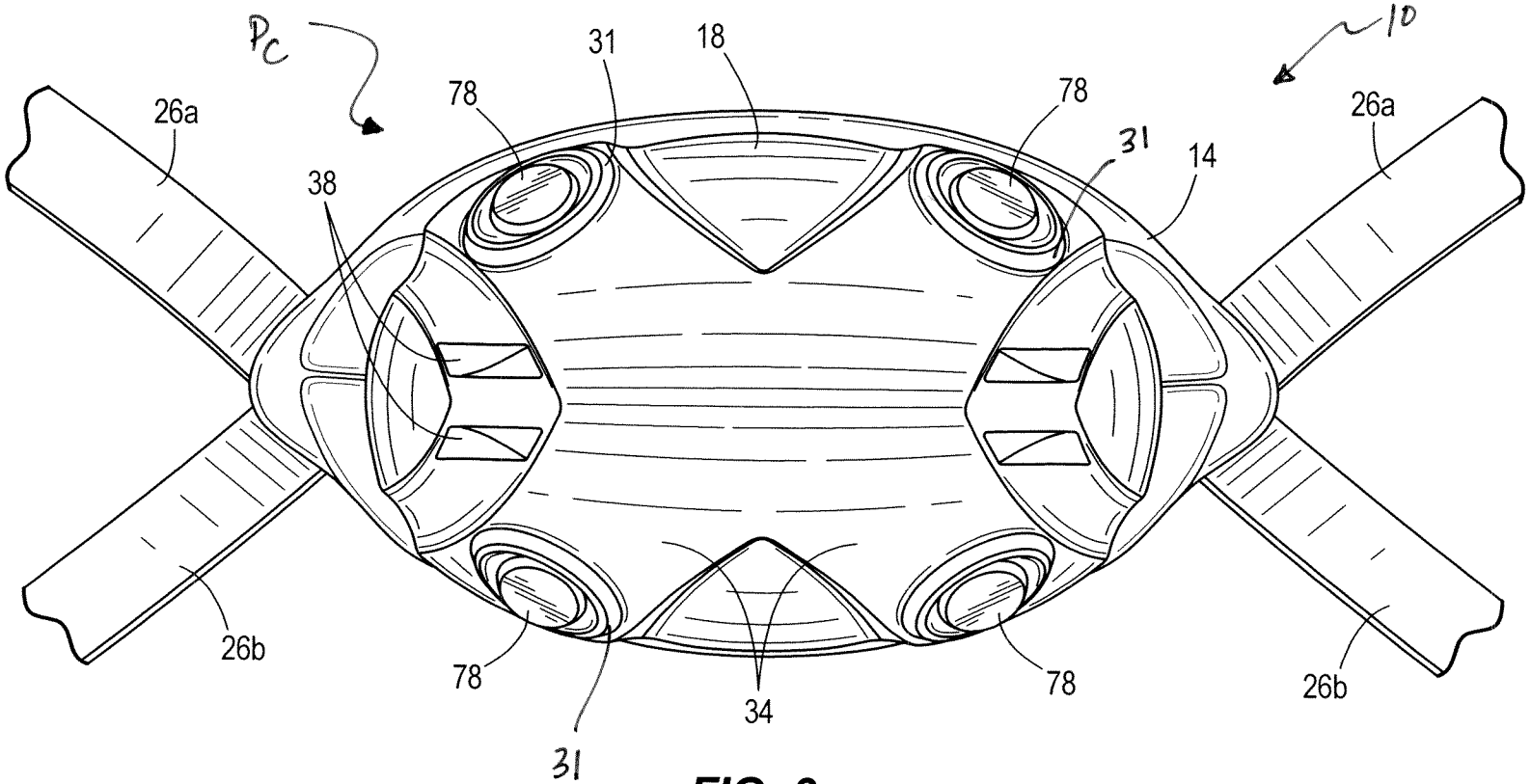
FIG. 3 is an enlarged front view of the chinstrap assembly of FIG. 1.
Figure 6:
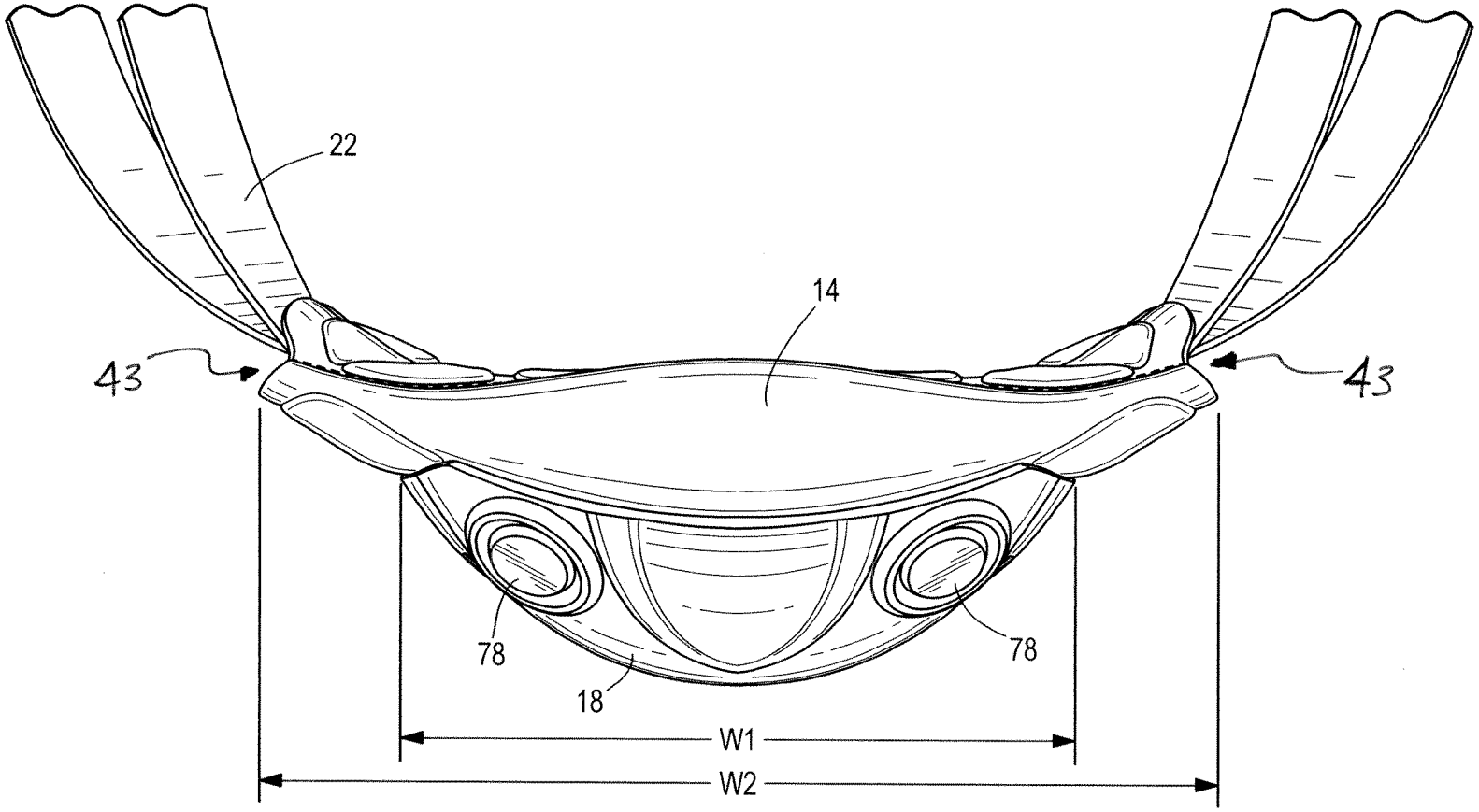
FIG. 6 is a top view of the chinstrap assembly of FIG. 1.
Figure 7:
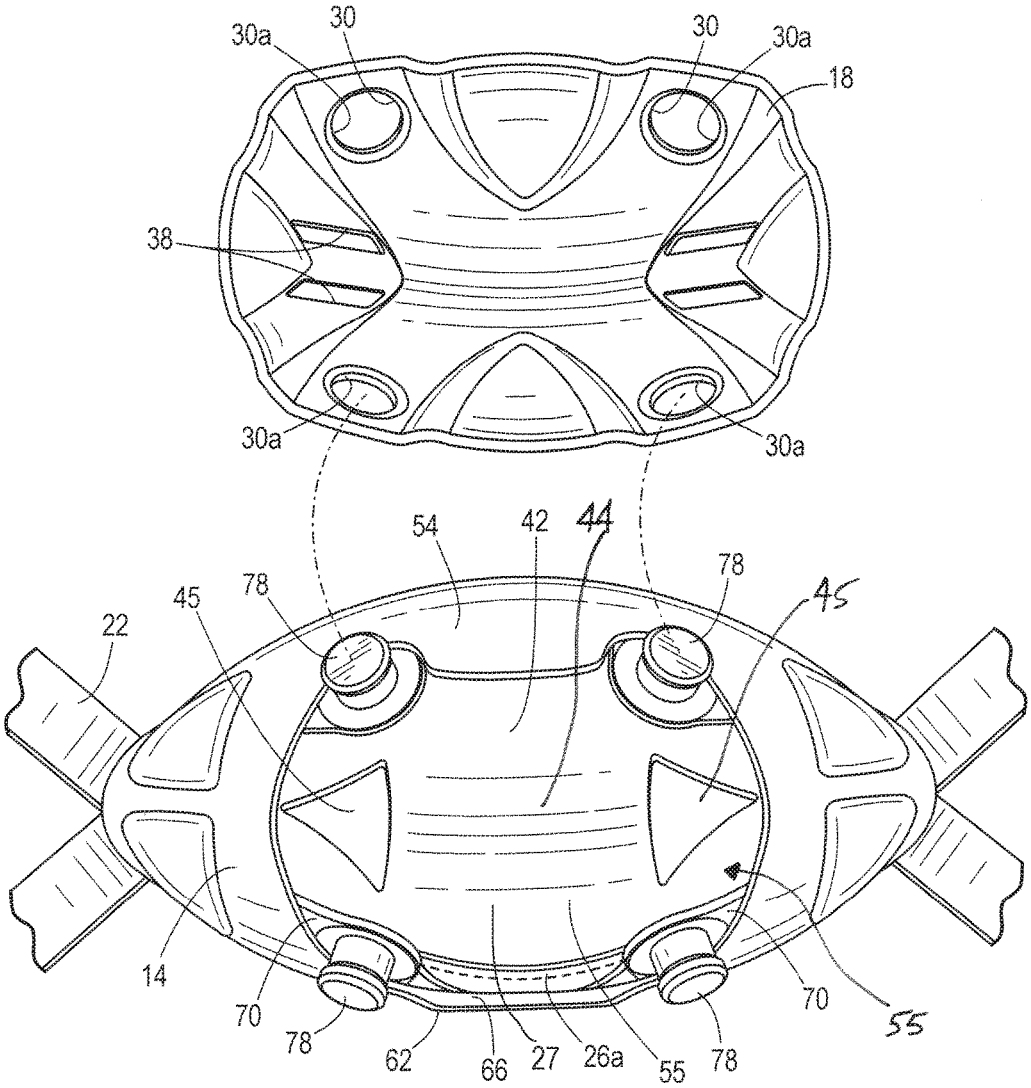
FIG. 7 is an exploded view of the chinstrap assembly of FIG. 1 showing an outer protective member removed.

As best shown in FIGS. 3, 6, and 7, in the illustrated embodiment, the outer protective member 18 has a substantially obround periphery (FIG. 3) and includes four attachment openings 30 located near the periphery of the outer protective member 18. A raised annular rib 31 surrounds each opening 30. Ribs 34 extend in an X-pattern between the openings 30 and ventilation openings 38 are provided on each side of the outer protective member 18 between the openings. The outer protective member 18 has a curvilinear configuration and is adapted to receive an extent of the inner pad member 14 (FIG. 6). In the illustrated embodiment the outer protective member 18 is formed from an impact resistant plastic, although other generally rigid, impact resistant materials, such as composites like carbon fiber, aramid, and/or fiberglass, may also be used.

Figure 5:
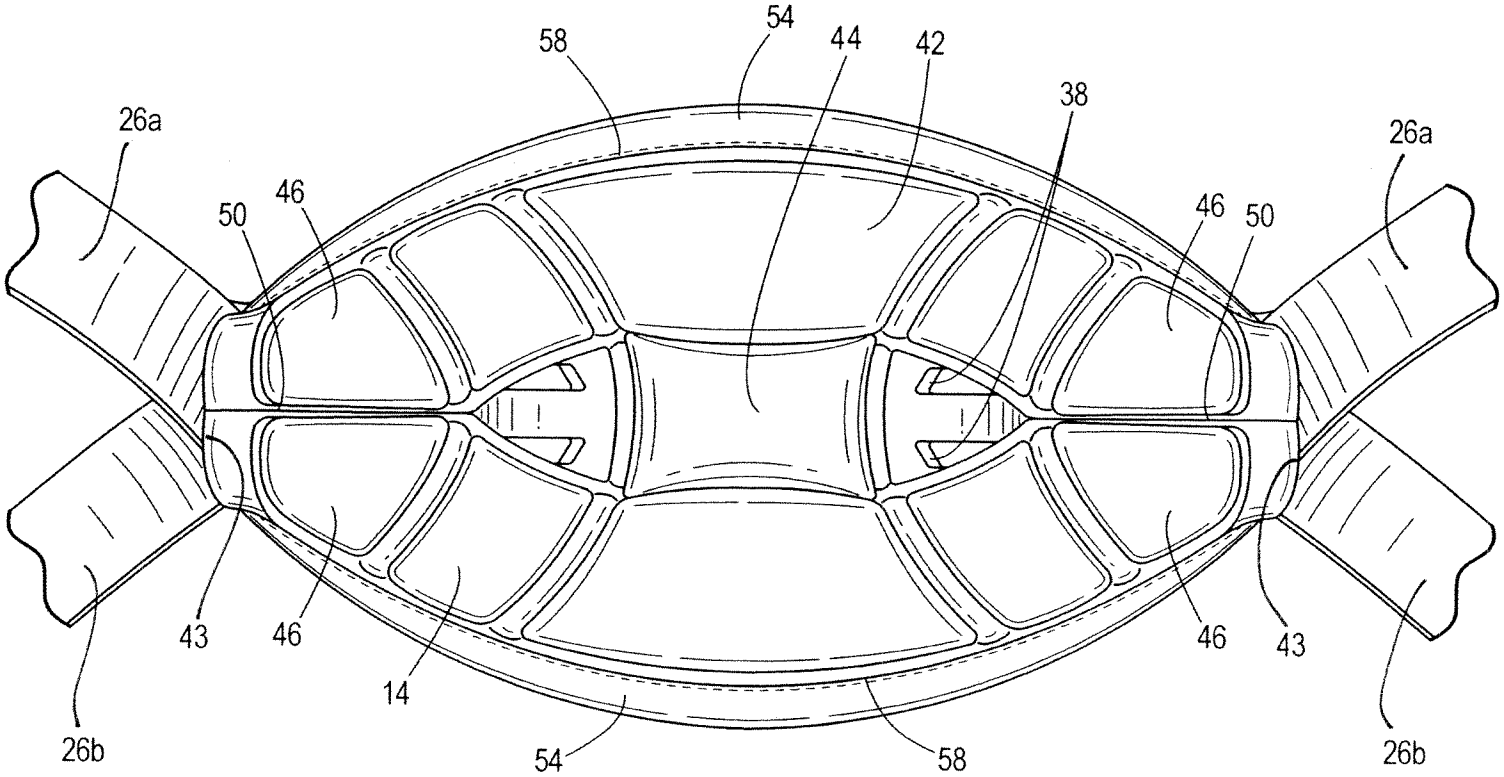
FIG. 5 is an enlarged rear view of the chinstrap assembly of FIG. 1.

As best shown in FIGS. 5 and 7, the inner pad member 14 includes an inner panel 42 having end portions 46 that are stitched to one another along longitudinal seam 50. Inner panel 42 includes a central portion 44 positioned between by a pair of openings 45 (see FIGS. 5 and 7). The inner pad member 14 also includes an outer panel 54 that is stitched to upper and lower edges of the inner panel 42, as at 58, while forming an opening 43 in opposed ends of the inner pad member 14. In this manner, the inner and outer panels 42, 54 are joined to form the inner pad member 14. The outer panel 54 includes a central opening 55 that has a larger configuration than the inner panel openings 45. As shown in FIG. 7, the central opening 55 exposes the posts 78 that comprise the attachment members 70. The illustrated inner and outer panels 42, 54 are formed by way of thermoforming and include an outer abrasion-resistant layer 62 formed of vinyl and an inner padded layer 66, preferably formed of foam.

Figure 2:
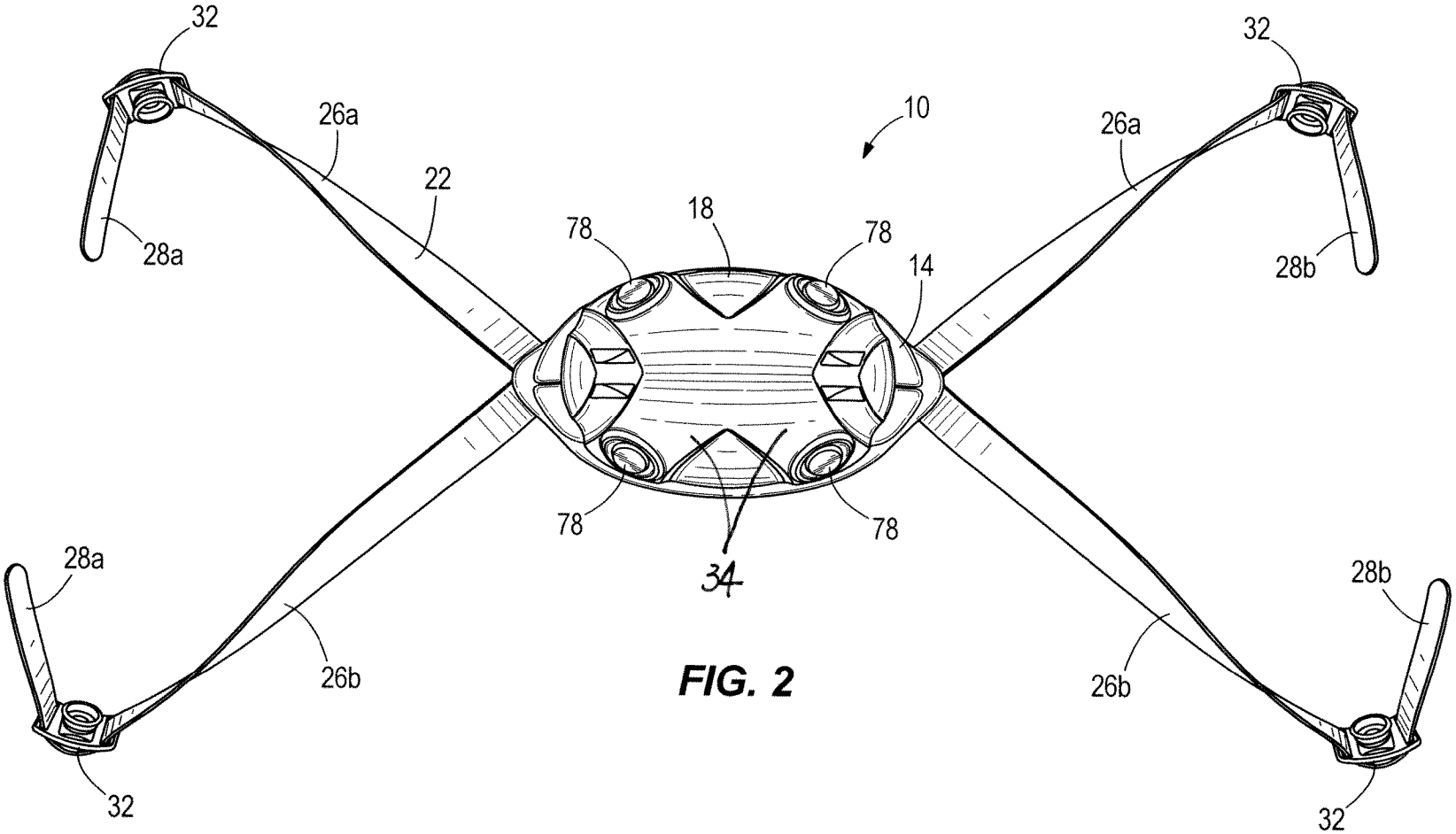
FIG. 2 is a front view of the chinstrap assembly of FIG. 1.
Figure 4:
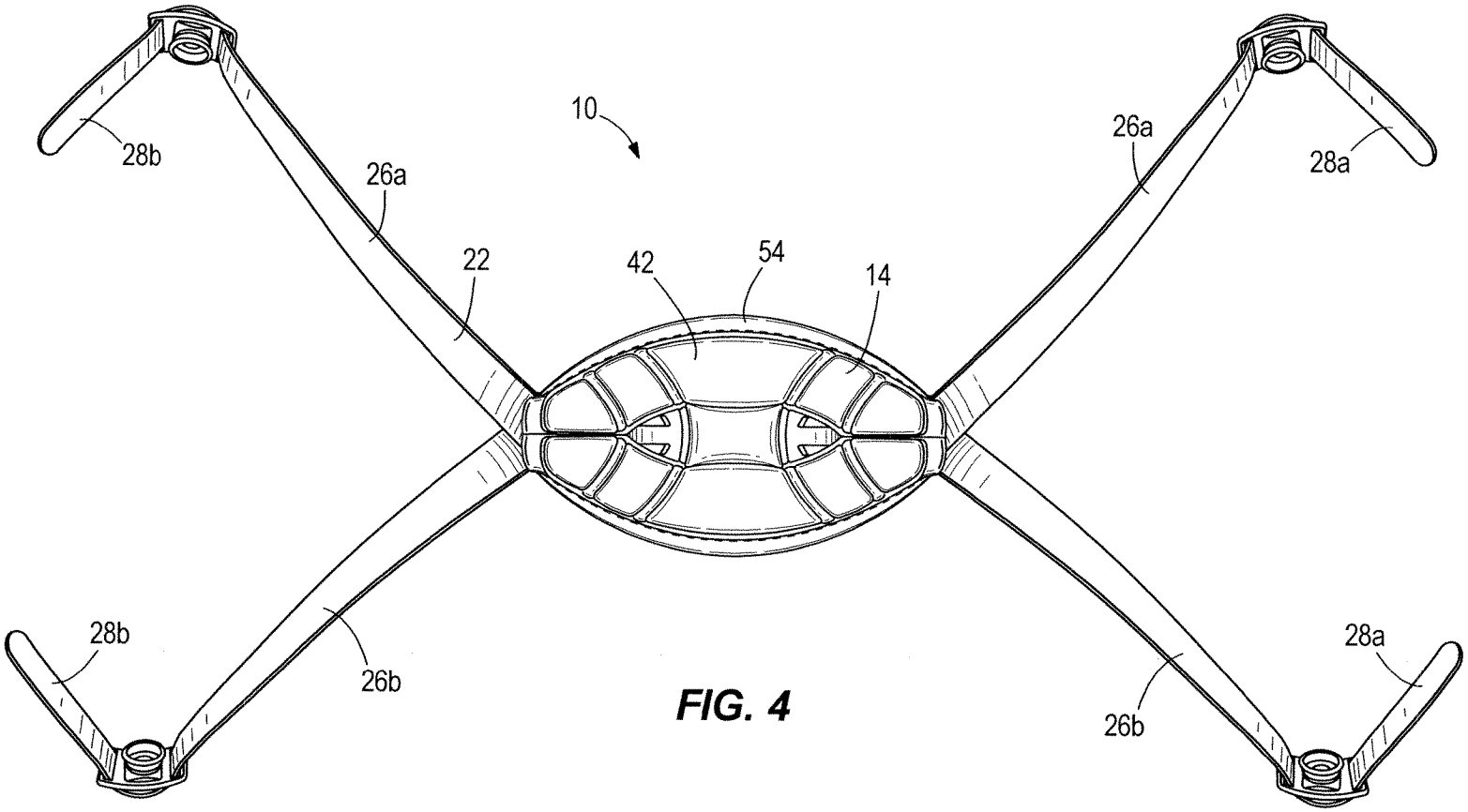
FIG. 4 is a rear view of the chinstrap assembly of FIG. 1.
Figure 8:
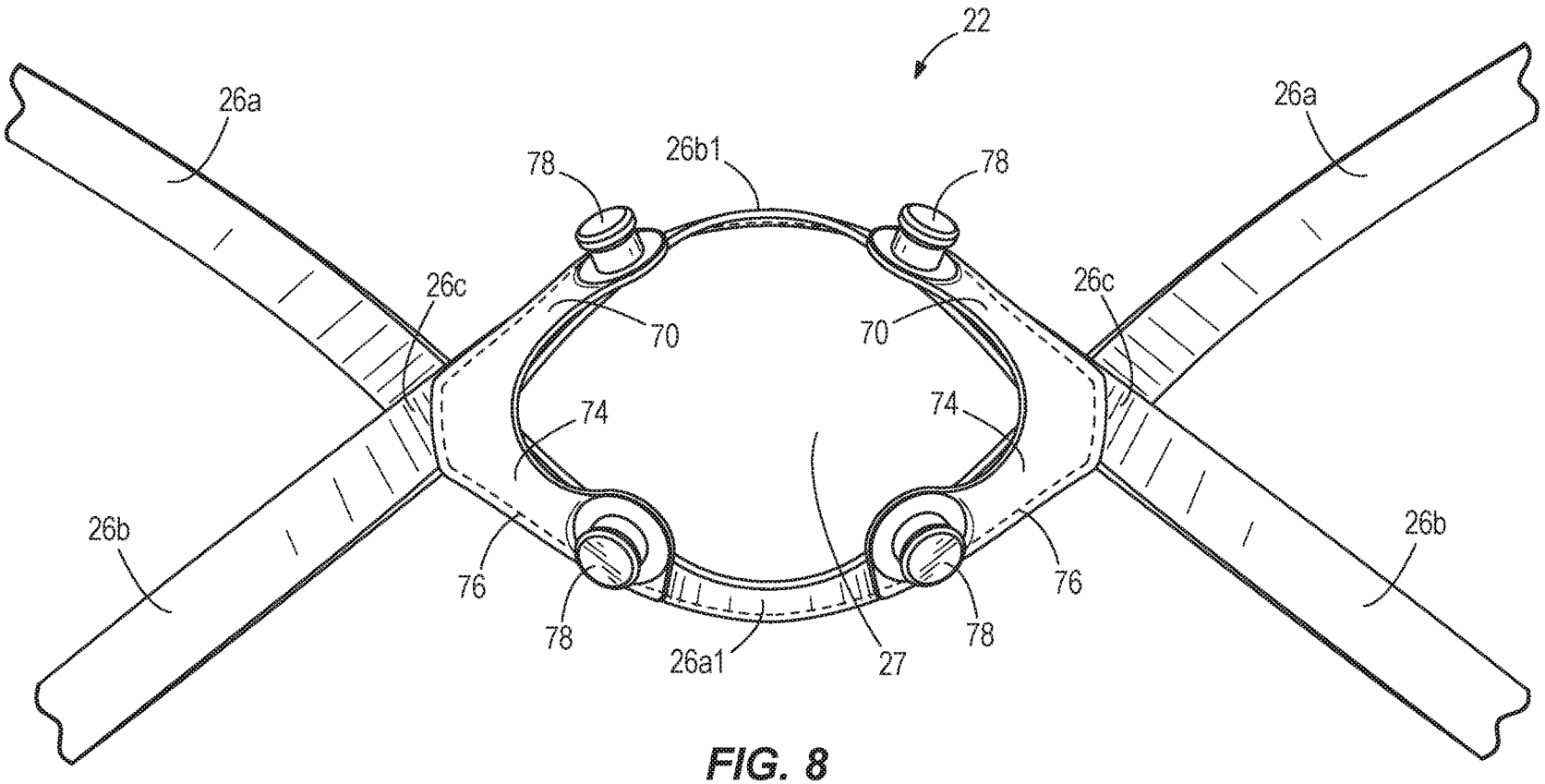
FIG. 8 is a front view of a strap assembly of the chinstrap assembly of FIG. 1.
Figure 9:
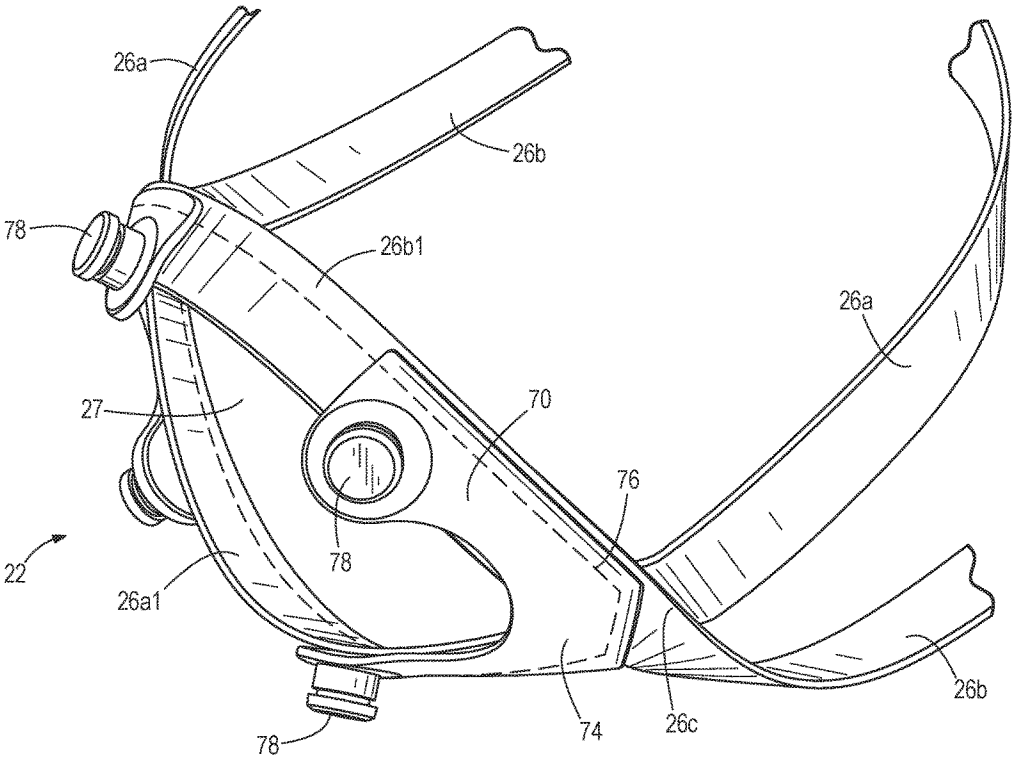
FIG. 9 is a perspective view of the strap assembly of FIG. 8.

Referring also to FIGS. 7-9, in the illustrated embodiment the strap assembly 22 includes two strap members 26*a*, 26*b* that extend through the openings 43 in the inner pad member 14 such that opposite ends 28*a*, 28*b* of each respective strap member 26*a*, 26*b* are positioned on opposite sides of the chinstrap assembly 10 (see FIGS. 2 and 4). Referring to FIGS. 8 and 9, the strap members 26*a*, 26*b* intersect and overlap at two distinct intersection locations 26*c* to form a central strap aperture 27. The intersection locations 26*c* are spaced approximately 4-6 inches apart, preferably 5 inches apart. In the embodiment shown in the Figures, the strap members 26*a*, 26*b* are fed through the end openings 43 of the inner pad member 14 such that (i) the ends of the inner pad member 14 are adjacent the intersection locations 26*c*, and (ii) the central portion 44 extends through the central strap aperture 27 while exposing the posts 78 that extend from the attachment members 70 through the central opening 55. As shown in FIGS. 8 and 9, each strap member 26*a*, 26*b* includes an intermediate portion 26*a*1, 26*b*1 positioned between the intersection locations 26*c*. When the chin strap assembly 10 is assembled, the intermediate portion 26*a*1 of first strap member 26*a*extends through and between end openings 43 of the inner pad member 14 and across a length of the inner pad member 14 defined between the end openings 43. Similarly, the intermediate portion 26*b*1 of second strap member 26*b*extends through and between end openings 43 of the inner pad member 14 and across the length of the inner pad member 14. An adjustable snap assembly 32, such as a buckle with integrated snap, is provided on each end 28*a*, 28*b*of each strap 26*a*, 26*b*for securing the chinstrap assembly 10 to a helmet. In other embodiments, four strap members may be used with each strap member having one free end and one end sewn or otherwise attached to the inner pad member 14. In still other embodiments, two strap members may be used but may be attached to the inner pad member 14 such that both ends of each strap are positioned on the same side of the chinstrap assembly 10. The strap member or members may be configured such that only one strap member extends from each side of the inner pad member 14. These and other variations on the specific arrangement of the strap assembly 22 fall within the spirit and scope of the present invention.

In the illustrated embodiment, the strap assembly 22 also includes means for removably coupling the outer protective member 18 to the strap assembly 22 in the form of a pair of attachment members 70 coupled to the strap members 26*a*, 26*b*. Each attachment member 70 includes a generally V-shaped web portion 74 that is joined (e.g., stitched or glued) to the strap members 26, 26*b* as at 76, a location substantially adjacent to where the strap members 26*a*, 26*b* cross one another. Each attachment member 70 also includes a pair of coupling members in the form of posts 78 positioned near or adjacent the ends of the V-shaped web portions 74. The posts 78 have an elongated configuration and are arranged for insertion into the attachment openings 30 in the outer protective member 18 to define a connected position Pc (see FIGS. 2, 3, and 6). In another embodiment, the web portion 74 is severely reduced, or even omitted from the attachment member 70 such that the posts 78 are operably connected to the strap 26*a*, 26*b*.

Figure 10:
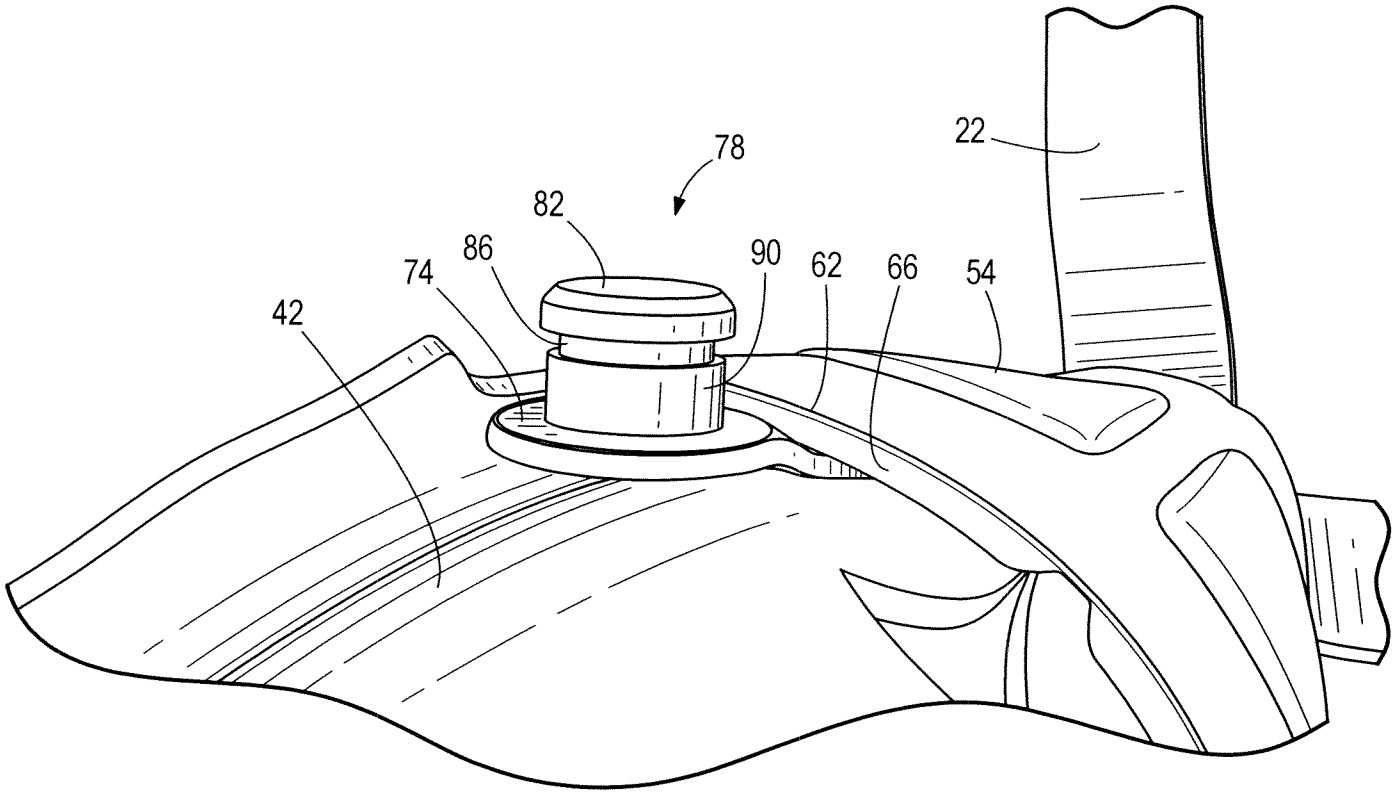
FIG. 10 is an enlarged side view of an attachment member for removably attaching the outer protective member of FIG. 7 to the chinstrap assembly.

Referring also to FIG. 10, each post 78 is generally mushroom-shaped and includes a rounded and enlarged top portion 82 adapted for insertion through a respective attachment opening 30. In the connected position Pc, the top portion 82 is substantially flush with the annular ridge 31 in the outer member 18. A circumferential groove 86 is located below the top portion 82 and receives an inner circumferential edge 30*a* of the respective attachment opening 30 in the connected position Pc. An elongated, preferably cylindrical, support portion 90 extends between the groove 86 and the web portion 74 of the attachment member 70. The support portion 90 has a height that appropriately spaces the outer protective member 18 a distance away from the strap assembly 22 such that portions of the inner pad member 22 reside between the strap assembly 22 and the outer protective member 18. In this regard, although portions of the inner pad member 14 and the outer protective member 18 may be in direct physical contact with one another, in the illustrated embodiment the outer protective member 18 is indirectly coupled to the inner pad member 14 by way of the posts 78 and the strap members 26*a*, 26*b*. This arrangement allows for relative movement between the outer protective member 18 and the inner pad member 14, as further described below.

Referring to FIGS. 7-10, the enlarged top portion 82 and groove 86 of each post 78 are cooperatively dimensioned with the attachment openings 30 in the outer protective member 18 to provide a secure snap fit between the posts 78 and the attachment openings 30 in in the connected position Pc. This reduces the likelihood of the outer protective member being inadvertently dislodged or removed from the strap assembly 22 during the course of play. Moreover, when the strap members 26*a*, 26*b* are secured, e.g., when the chinstrap assembly 10 is properly attached to a helmet by securing the snap assemblies 32 to the helmet, the posts 78 on each side of the chinstrap assembly 10 may be pulled or rotated generally outwardly (towards the helmet) such that the grooves 86 are biased or urged into further or deeper engagement with the outer portions of the circumferential edges 30*a* of the attachment openings. In some applications, the wearer's chin may function as a fulcrum such as the strap members 26*a*, 26*b* are pulled taut when the chinstrap assembly 10 is attached to the helmet, the posts 78 on each side of the chinstrap assembly 10 angularly deflect in a generally outward and upward direction (with respect to the wearer's head) such that the grooves 86 move into further or deeper engagement with the circumferential edges 30*a* of their respective attachment openings 30. These effects can reduce the likelihood of the outer protective member 18 being dislodged or removed from the strap assembly 22 during the course of play. However, when the chinstrap assembly 10 is removed the posts 78 return to un-deformed, un-deflected positions, wherein the posts 78 are essentially centered with respect to the attachment openings 30 to allow the outer protective member 18 to be removed from the strap assembly 22 by the wearer of the helmet (or the training or coaching staff), if desired.

By attaching the relatively rigid outer protective member 18 to the strap assembly 22 in discrete, spaced apart locations (e.g., at the posts 78) at the connected position Pc, relative movement is permitted between the outer protective member 18 and portions of the strap assembly 22. Even though movement of the straps 26*a*, 26*b* immediately adjacent the posts 78 is somewhat limited due to coupling of the posts 78 with the outer protective member 18, flexing and bending of the straps 26*a*, 26*b* are permitted in those portions of the strap assembly 22 that extend between and away from the posts 78. Such flexing and bending of the strap assembly 22 and the inner pad member 14 functions to accommodate, for example, anatomical variations in the chin and jaw line of the helmet wearer to provide a more customized and comfortable fit. Another structural feature that permits flexing and bending of the inner pad member 14 and the strap assembly 22 is the reduced width W1 of the outer protective member 18 with respect to the width W2 of the inner pad member 14 (FIG. 6), which allows outermost portions of the inner pad member 14 to flex and bend.

Several alternative configurations of the inner pad member 14, outer protective member 18, and strap assembly 22 are possible without departing from the spirit and scope of the present invention. For example, in some embodiments, more or fewer posts 78 can be used, including two posts, a single post, three posts, and the like, in a variety of arrangements, without limitation. In some embodiments, the post or posts 78 can also or alternatively be attached to the inner pad member 14. Moreover, in some embodiments the orientation of the attachment members 70 and the openings 30 are reversed, wherein posts (or similar projections) are provided on the outer protective member 18 and suitable openings or recesses could be provided on the inner pad member 14 and/or the strap assembly 22. As noted above, some embodiments can include a different arrangement or configuration of straps 26*a*, 26*b*, and/or different configurations and structures for the inner pad member 14 and the outer protective member 18. These and other variations, whether taken alone or in combination, all fall within the spirit and scope of the present invention.

It is to be understood that the invention is not limited to the exact details of construction, operation, exact materials or embodiments shown and described, as obvious modifications and equivalents will be apparent to one skilled in the art; for example, the entire cantilever strap could be provided with a shock absorbing pad disposed upon its lower surface. Accordingly, the invention is therefore to be limited only by the scope of the appended claims. While the specific embodiments have been illustrated and described, numerous modifications come to mind without significantly departing from the spirit of the invention, and the scope of protection is only limited by the scope of the accompanying Claims.

What is claimed is:

1. A multiple component protective chin strap assembly configured to be removably connectable to a protective sports helmet, the multiple component protective chin strap assembly comprising:

an inner pad member adapted to engage an extent of a chin of a person wearing the protective chin strap, the inner pad member having opposed first and second terminal ends that define a length of the inner pad member, the inner pad member also having an inner panel and an outer panel, the outer panel having a central opening, wherein the central opening resides in an intermediate region of the outer panel between the first and second terminal ends of the inner pad member;

a strap assembly comprising a first elongated strap member and a second elongated strap member extending through the first and second terminal ends of the inner pad member, wherein an intermediate portion of said first strap member extends through and between said first and second terminal ends of the inner pad member and across said length of the inner pad, and wherein an intermediate portion of said second strap member extends through and between said first and second terminal ends of the inner pad member and across said length of the inner pad;

an outer protective member releasably coupled to the strap assembly adjacent the inner pad member; and at least one attachment member secured to one of the first and second strap members of the strap assembly, the attachment member comprising a post extending outwardly from a respective one of the first and second strap members and through the central opening of the inner pad member.

2. The multiple component protective chin strap assembly of claim 1, wherein the outer protective member includes an opening that receives the post to releasably couple the outer protective member to the strap assembly and define a connected position.

3. The multiple component protective chin strap assembly of claim 2, wherein the post has a top portion and a groove, wherein the groove engages an inner edge of the opening of the outer protective member in the connected position.

4. The multiple component protective chin strap assembly of claim 3, wherein in the connected position the top post portion is substantially flush with an outer surface of the outer protective member.

5. The multiple component protective chin strap assembly of claim 1, wherein the first and second strap members overlap at two distinct intersection locations to form a central strap aperture between said intersection locations, wherein the central strap aperture is aligned with the central opening of the inner pad member.

6. The multiple component protective chin strap assembly of claim 5, wherein the distance between the intersection locations is 4-6inches.

7. The multiple component protective chin strap assembly of claim 1, the inner panel of the inner pad member having a central portion that extends through the central opening formed in the outer panel of the inner pad member.

8. A sports helmet comprising:

a shell configured to receive a head of a wearer of the helmet;

a multiple component protective chin strap assembly removably connected to the shell, the chin strap assembly including:

an inner pad member adapted to engage an extent of a chin of a person wearing the protective chin strap, the inner pad member having opposed left and right outermost ends that define a length of the inner pad member, the inner pad member also having an inner panel and an outer panel, the outer panel having a central opening that resides within an intermediate region of the outer panel between the left and right outermost ends;

a strap assembly comprising a first elongated strap member and a second elongated strap member extending through the left and right outermost ends of the inner pad member, wherein an intermediate portion of said first strap member extends through and between said left and right outermost ends of the inner pad member and across said length of the inner pad, and wherein an intermediate portion of said second strap member extends through and between said left and right outermost ends of the inner pad member and across said length of the inner pad;

an outer protective member releasably coupled to the strap assembly adjacent the inner pad member; and at least one attachment member secured to one of the first and second strap members of the strap assembly, the attachment member including an outwardly extending post disposed within and extending through the central opening of the inner pad member.

9. The sports helmet of claim 8, wherein the outer protective member includes an opening that receives the post to releasably couple the outer protective member to the strap assembly and define a connected position of the chin strap assembly.

10. The sports helmet of claim 9, wherein the post includes a top portion and a groove, wherein the groove engages an inner edge of the opening of the outer protective member in the connected position.

11. The sports helmet of claim 10, wherein in the connected position the post is received by the opening in the outer protective member and the top post portion is substantially flush with an outer surface of the outer protective member.

12. The sports helmet of claim 8, wherein the first and second strap members overlap at two distinct intersection locations to form a central strap aperture between said intersection locations, and wherein opposed ends of the inner pad member are positioned adjacent the intersections locations.

13. The sports helmet of claim 12, wherein the distance between the intersection locations is 4-6inches.

14. A multiple component protective chin strap assembly configured to be removably connectable to a protective sports helmet, the multiple component protective chin strap assembly comprising:

an inner pad member adapted to engage an extent of a chin of a person wearing the protective chin strap, the inner pad member having an inner panel and an outer panel, the outer panel having a central opening, and opposed first and second terminal end openings that define a length of the inner pad member, wherein the central opening resides in an intermediate region of the outer panel between the first and second terminal end openings;

a strap assembly comprising a first elongated strap member and a second elongated strap member that overlap at two distinct locations to form a central strap aperture, wherein an extent of said first strap member extends through and between said first and second terminal end openings of the inner pad member and across said length of the inner pad, wherein an extent of said second strap member extends through and between said first and second terminal end openings of the inner pad member and across said length of the inner pad;

wherein the central strap aperture is aligned with the central opening of the outer panel of the inner pad member, and wherein a central portion of the inner panel of the inner pad member extends through the central strap aperture; and an outer protective member releasably coupled to the strap assembly adjacent the inner pad member.

15. The multiple component protective chin strap assembly of claim 14, the chin strap assembly further comprising at least one attachment member secured to one of the first and second strap members of the strap assembly, the attachment member disposed within and extending through the central opening in the inner pad member.

16. The multiple component protective chin strap assembly of claim 15, wherein the outer protective member includes an opening that receives the attachment member to releasably couple the outer protective member to the strap assembly and define a connected position.

17. The multiple component protective chin strap assembly of claim 16, wherein the attachment member is a post with a top portion and a groove, wherein the groove engages an inner edge of the opening of the outer protective member in the connected position.

18. The multiple component protective chin strap assembly of claim 15, wherein the attachment member extends through the central opening of the inner pad member without coupling to the inner pad member.

19. The multiple component protective chin strap assembly of claim 1, wherein the outer protective member has opposed first and second ends that define a length, and wherein the length of the outer protective member is less than the length of the inner pad member.

20. The multiple component protective chin strap assembly of claim 1, wherein a periphery of the outer protective member is less than a periphery of the inner pad member, wherein an extent of the outer panel is exposed.

21. The multiple component protective chin strap assembly of claim 8, wherein the outer protective member has opposed first and second ends that define a length, and wherein the length of the outer protective member is less than the length of the inner pad member.

22. The multiple component protective chin strap assembly of claim 8, wherein a periphery of the outer protective member is less than a periphery of the inner pad member, wherein an extent of the outer panel is exposed.

23. The multiple component protective chin strap assembly of claim 14, wherein the outer protective member has opposed first and second ends that define a length, and wherein the length of the outer protective member is less than the length of the inner pad member.

24. The multiple component protective chin strap assembly of claim 14, wherein a periphery of the outer protective member is less than a periphery of the inner pad member, wherein an extent of the outer panel is exposed.

* * * * *